US007213310B2

(12) United States Patent
Van Wersch

(10) Patent No.: US 7,213,310 B2
(45) Date of Patent: May 8, 2007

(54) DEVICE FOR FINISHING DENIM WOVEN FABRIC

(76) Inventor: Kurt Van Wersch, Hölderlinstrasse 21, 41844 Wegberg (DE)

( * ) Notice: Subject to any disclaimer, the term of this patent is extended or adjusted under 35 U.S.C. 154(b) by 468 days.

(21) Appl. No.: 10/502,988

(22) PCT Filed: Sep. 17, 2003

(86) PCT No.: PCT/DE03/03078

§ 371 (c)(1),
(2), (4) Date: Jul. 29, 2004

(87) PCT Pub. No.: WO2004/061190

PCT Pub. Date: Jul. 22, 2004

(65) Prior Publication Data

US 2005/0122511 A1 Jun. 9, 2005

(30) Foreign Application Priority Data

Dec. 20, 2002 (DE) ..... 102 59 868
Feb. 22, 2003 (DE) ..... 103 07 914

(51) Int. Cl.
*D06H 3/08* (2006.01)

(52) U.S. Cl. ..... 26/51.4; 26/51.5; 26/18.6; 26/74

(58) Field of Classification Search ..... 26/18.5, 26/18.6, 51, 51.3, 51.4, 51.5, 74, 75–79; 356/238.1, 238.2; 73/159, 160; 139/1 B; 226/15, 16, 20, 21, 23, 24
See application file for complete search history.

(56) References Cited

U.S. PATENT DOCUMENTS 3,691,600 A 9/1972 Joy
3,721,809 A * 3/1973 Strandberg et al. ..... 377/2
3,959,826 A 6/1976 Hakanson
4,015,318 A * 4/1977 Hakanson ..... 28/165
4,017,722 A * 4/1977 Swanson ..... 700/130
4,162,563 A * 7/1979 Lawrence et al. ..... 28/163

(Continued)

FOREIGN PATENT DOCUMENTS

DE 33 36 328 5/1985

(Continued)

OTHER PUBLICATIONS

International Search report.

*Primary Examiner*—Amy B. Vanatta
(74) *Attorney, Agent, or Firm*—Collard & Roe, P.C.

(57) ABSTRACT

A device for finishing woven denim textiles is described which, proceeding from unfinished goods, is supposed to be brought to predetermined reference values for finished width, skew and woof thread density. The device is supposed to be designed for continuous operation for regulating all three reference values. According to the invention, a stretching device, such as a rack or a loop dryer, and a shrinkage system for continuous throughput of the woven denim textile, are arranged one after the other. Directly behind the stretching device, particularly, at the same time, behind the shrinkage system, a single measuring device, preferably as an optical detector having a digital camera, is provided. The measuring device is designed, at the same time, for detecting the actual values of finished width, skew and woof thread density, and is supposed to be connected, in control circuits, with devices for achieving the reference values.

6 Claims, 1 Drawing Sheet

U.S. PATENT DOCUMENTS

Figure 1:
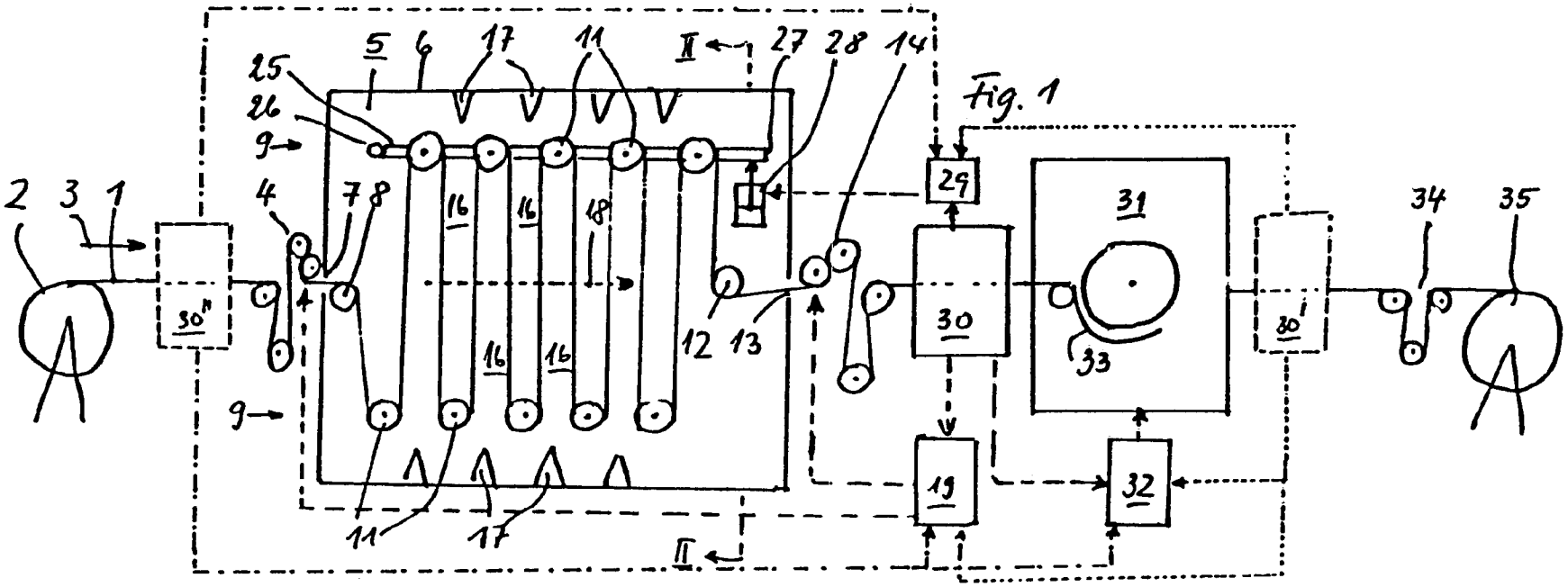

| | | | | |
|---|---|---|---|---|
| 4,255,050 | A | 3/1981 | Beckstein et al. | |
| 4,305,184 | A * | 12/1981 | Woythal | 26/51.5 |
| 4,586,372 | A * | 5/1986 | Massen | 73/159 |
| 4,788,756 | A * | 12/1988 | Leitner, Sr. | 26/51.4 |
| 4,920,621 | A * | 5/1990 | Metzen | 26/18.6 |
| 6,550,656 | B2 * | 4/2003 | Kurz | 226/19 |
| 2006/0053840 | A1 * | 3/2006 | Van Wersch | 68/5 C |

FOREIGN PATENT DOCUMENTS

| | | |
|---|---|---|
| DE | 43 23 715 | 8/1994 |
| WO | WO2004/017003 | 2/2004 |

* cited by examiner 35
34
30'
31
33
32
29
30
19
14
28
27
13
12
II
II
11
18
16
17
5
6
7
8
25
26
9
4
30"
1
3
2

24
28
6
1
23
11
21
22

DEVICE FOR FINISHING DENIM WOVEN FABRIC

CROSS REFERENCE TO RELATED APPLICATIONS

Applicant claims priority under 35 U.S.C. §119 of German Applications Nos. 102 59 868.1 filed on Dec. 20, 2002 and 103 07 914.9 filed on Feb. 22, 2003. Applicant also claims priority under 35 U.S.C. §365 of PCT/DE03/03078 filed on Sep. 17, 2003. The international application under PCT article 21(2) was not published in English.

The invention relates to a device for finishing a denim textile web which, proceeding from unfinished goods, is supposed to be brought to predetermined reference values for finished width, skew and woof thread density, having a stretching device, for example a rack or hot flue, which has both stretching means for drawing the woven textile in its length, as well as slant positioning means for applying a skew, and having a shrinkage system assigned in continuous operation, preferably following the stretching device, having compression means for adjusting a woof thread density. Such a device is also referred to as a denim finishing line.

The denim process chain in the production of denim clothing, for example so-called jeans, proceeding from the unfinished woven textile, comprises so-called denim processing, also called woven textile finishing. This includes drying, stretching in length, and so-called skewing, as well as making the textile web shrink-resistant. In the case of the aforementioned skewing (English: skewing), the woven textile is drawn diagonally with reference to the warp and woof (skew). For this purpose, special slant racks are used, in practice.

Unfinished denim goods are normally produced at an unfinished width, e.g. 162 cm, which is clearly greater than the finished width, e.g. 151 cm. In order to obtain the finished width, the unfinished goods are drawn in length. The woof thread density (number of threads per unit of length), which is reduced as a result, is subsequently brought to the desired value in a shrinkage system, particularly having a rubber band shrinkage unit as the core machine. A measurement and regulation method, with which the reference value of the goods shrinkage to be achieved is determined and given to the rubber band shrinkage unit as a regulation value, is known from DE 43 23 715 A1. The residual shrinkage and the thread density per centimeter stand in a direct relationship with one another for a certain grade, i.e. if the fiber density at the exit of the finishing line is known the residual shrinkage value is also given.

Drawing the denim textile web in length can take place in a conventional rack, having a plurality of top and bottom rollers or, for example, also in a loop dryer, in short, a hot flue, if the latter possesses corresponding length stretching means. A suitable hot flue is described in DE 33 36 328 C2. It comprises a top series and a bottom series of guide rollers. In the known hot flue, the two series of guide rollers are mounted in a housing, parallel to one another and horizontally, essentially each in a plane. The housing possesses a horizontal inlet slit in an inlet wall, through which slit the textile web to be treated is to be introduced, spread out; analogously, there is an outlet slit in an outlet wall.

The (straight) connecting line between the inlet slit and the outlet slit defines the average transport direction of the textile web in the hot flue. In fact, however, the textile web is transported alternately over a bottom guide roller and a top guide roller, in loop shape or meander shape. Within the housing, rows of blowing nozzles are provided, arranged parallel to the guide rollers, which nozzles are used to blow treatment agents, particularly heated air (generally ambient air) onto the textile web, i.e. into the tensioned textile web loops.

Within the hot flue, the textile web is held under a predetermined lengthwise textile web tension, using web tensioning means that precede and follow the dryer. This lengthwise tension is supposed to be at least so great that even in the case of a goods content of thirty or more meters of textile web, it is ensured that the goods proceed through the hot flue essentially fold-free.

The skew of the woof threads, i.e. a slanted position of the woof threads relative to the warp threads of the woven textile that clearly deviates from 90°, is achieved, when using a conventional rack, for example, by setting part of the rack rollers at a slant. In most cases, the top rack rollers are raised vertically on one side (at their one longitudinal end), or the bottom rollers are lowered vertically at one end.

It has also been proposed already, as a means for setting a slanted position to produce a skew (German patent application 102 34 799.9 dated Jul. 31, 2002, not published prior to this invention), to provide a hot flue for denim goods, which has means for exerting a lengthwise draw (in other words stretching means) preceding and following it, and in the housing of which at least one group of at least one series of guide rollers can be tilted at a slant in one direction. The core of the related recognition is that a separate device for setting a slanted position can be entirely eliminated by setting at least part of the guide rollers of the hot flue at a slant. The remaining work result of the hot flue, which is normally expected, is not impaired by setting the guide rollers at a slant.

The invention is based on the task of bringing together in one system a stretching device, such as a rack or a hot flue with a subsequent width stretching field (for setting the goods width) and a rubber band shrinkage unit (as the core machine for an adjustable lengthwise shrinkage), and controlling the system in such a manner that the parameters of residual shrinkage, skew and width, which are decisive for determining how the goods turn out, remain reproducibly constant. In other words, the result to be achieved with the combined system is that when woven denim textiles are finished, predetermined reference values of textile web width, skew and woof thread density can be continuously obtained in one pass.

The solution according to the invention is indicated, for the device stated initially, in the characterizing part of claim 1. Some improvements and additional embodiments of the invention are described in the dependent claims.

The device for finishing woven denim textiles, proceeding from unfinished goods, preferably comprises a rack or a hot flue as a stretching device, whereby the stretching device has both stretching means for lengthwise drawing of the woven textile and means for setting a slanted position, to apply a skew, assigned to it, and a shrinkage system that functions in continuous operation, having compressing means for setting a (particularly a predetermined) thread density. According to the invention, the device contains a single measuring device for detecting the actual values of goods width, skew and woof thread density, which is connected in a control circuit, in each instance, to control the stretching and slanted positioning means of the stretching device, on the one hand, and the compression means of the shrinkage system, on the other hand, to achieve the reference values, in each instance.

Preferably, the measuring device is supposed to immediately follow the stretching device (in other words particularly the rack or the width stretching field of the hot flue) or the shrinkage device. "Immediately follow" means, in this connection, that the supply of the textile web between the device to be controlled (rack or hot flue, respectively, or shrinkage device) and the measuring device is supposed to be minimal, in order to keep the amount of the goods that might have been treated incompletely, before the control circuit goes into effect, small. However, the least textile web loss in this sense is to be expected if the measuring device actually precedes the first textile web finishing stage, in other words generally the rack or the hot flue. Aids, e.g. web tension regulators, can be arranged between the device to be controlled and the measuring device.

The result achieved by means of the invention is that the reference values of textile web width, skew and woof thread density can be achieved in one pass, using a correspondingly configured rack or a correspondingly configured hot flue, and a shrinkage system, as well as a single measuring device, with continuous transport of the woven denim goods, which are finished in usual manner in the system.

In a first step, the textile web width (at the expense of the woof thread density) and the skew of the woof threads are adjusted to a predetermined reference value. In the subsequent second step, which is continuous, the woof thread density, which was previously reduced in the shrinkage system (during lengthwise stretching), is also brought to the predetermined reference value. According to the invention, both steps are controlled using one and the same measuring device.

Within the scope of the invention, an optical detector having a digital camera that can detect the thread density, the skew and the goods width is preferably used as the measuring device. In its measuring and regulation work, the detector is supposed to be guided crosswise to the transport direction of the textile web, traversing it, in order to achieve the result that it can register the textile web width, the amount of skew, and the woof thread density, all at the same time, and input them into the related control circuit.

If the measuring device follows the stretching device but precedes the shrinkage system, the following control pulses should be issued by it, for example by the digital camera having an optical detector (to achieve the reference values, in each instance):

a) backwards to a mechanism that sets either the top or the bottom roller series of the rack or the hot flue at a slant, if necessary, b) backwards to the pressure transducer of a pneumatically activated pendulum, for example, or to the reference value setter of a web force regulation system of the stretching device, which increase or decrease the goods tension as the goods pass through the stretching device, in interplay with a driven tension roller, so that the width can be changed in this manner, and c) forwards to the stepper motor of the pressure roller of the rubber band shrinkage unit, so that the predetermined goods shrinkage is achieved by changing the rubber band contact pressure.

If the measuring device is positioned on the textile web ahead of the stretching device and ahead of the shrinkage system, all three parameters must be regulated forwards. It also lies within the scope of the invention to position the measuring device at the end of the finishing line, in other words following the shrinkage system, even immediately before winding the goods up, stacking them, or the like, so that the three parameters described above are all regulated backwards.

Figure 2:
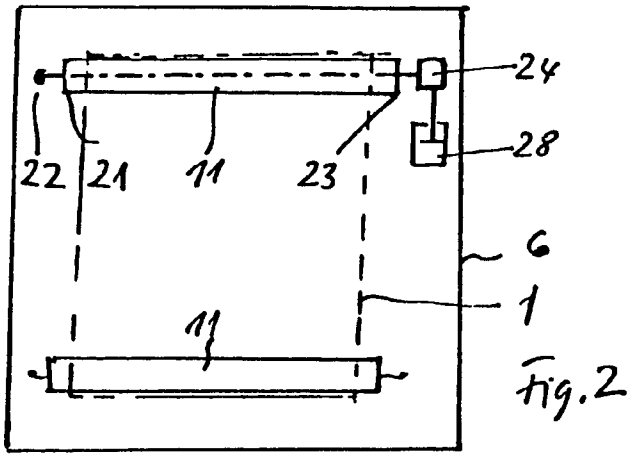

Details of the invention will be explained using the schematic representation of an exemplary embodiment having a hot flue as the stretching device. The drawing shows:

FIG. 1 a total system according to the invention, in vertical cross-section; and FIG. 2 a cross-section along the line II—II of FIG. 1.

According to FIG. 1, a denim textile web 1 is guided through a first tensioning means 4, from a roller 2, in the transport direction 3, into a hot flue designated as a whole as 5, having a housing 6. The housing 6 possesses an essentially horizontal inlet slit 7 with a deflection roller 8, as well as, in the interior, two series 9 of guide rollers 11. The textile web 1 is guided around the guide rollers 11, in meander-shaped loops, upwards and downwards, and finally passed, by way of a deflection roller 12, to a second tensioning means 14 through an outlet slit 13 of the housing 6. Within the housing 6, blower nozzles 17 are provided, which are directed into the textile web loops 16, which are stretched out between two guide rollers 11 of a roller series 9, in each instance. The lengthwise draw to be exerted on the textile web 1 within the hot flue 5, in defined manner, is adjusted using a lengthwise draw control device 19, between the two tensioning means 4 and 14, in the direction of the average transport direction 18 of the textile web 1.

In the exemplary embodiment according to FIGS. 1 and 2, the top guide rollers 11 are set in articulated bearings 22 at one of their longitudinal ends 21, and mounted in a beam 24 at the other of their longitudinal ends 23, which beam is held in a tilt bearing 26 at its one longitudinal end 25, as shown in FIGS. 1 and 2, and rests on a slant positioning device 28 at its other (subsequent, in the web transport direction 2) longitudinal end 27. The latter device has a slant positioning control device 29 assigned to it. In the transport direction 3, the tilt bearing 26 and the longitudinal end 27 with the slant positioning device come first.

In the transport direction 3, the tensioning means 14 according to FIG. 1 are immediately followed, according to the invention, by a measuring device 30. In the transport direction 3, a shrinkage device 31 having a shrinkage control device 32 and compression means 33 follows. At the end, the finished woven textile can be rolled onto a roller 35 by way of a tension regulator 34.

In the measuring device 30, which is preferably configured as an optical detector having a digital camera, the goods width, the skew and the woof thread density are determined. The device expenditure remains relatively low, if the measuring device 30 is allowed to traverse the textile web 1 crosswise to the transport direction 2 [sic], for example on a rail arranged crosswise to the transport direction 3. If the measuring head is appropriately controlled to move back and forth in defined manner, it is possible, in relatively simple manner, to measure the actual values of textile web width, skew and woof thread density achieved in the hot flue 5 (from the first tensioning means 4 to the second tensioning means 14) almost continuously. The values determined in the measuring device 30 in this way are passed to the control devices 19 and 29 (lengthwise draw and skew), as well as to the shrinkage control unit 32, along the lines of effect shown with broken lines, in such a manner that a corresponding control circuit for achieving predetermined reference values is formed, in each instance.

According to FIG. 1, the measuring device 30 precedes the shrinkage device 31. Alternatively, the measuring device can follow the shrinkage device. As an example, such a measuring device 30', which is preferably configured just like the measuring device 30, is shown with broken lines in FIG. 1. The related control lines (connections to the control devices 19, 29, and 32) are characterized by dot-dash lines of effect.

In another preferred alternative, the measuring device 30" actually precedes the first finishing stage, e.g. also the hot flue. The loss of incorrectly finished textile web yardage can then be kept very low. The lines of effect assigned to the position of the measuring device 30" are shown with dot-dash lines.

REFERENCE SYMBOL LIST

1=denim textile web
2=roller
3=transport direction
4=first tensioning means
5=hot flue
6=housing (5)
7=inlet slit (6)
8=deflection roller
9=guide roller series
11=guide roller
12=deflection roller
13=outlet slit
14=second tensioning means
16=textile web loop
17=blowing nozzles
18=average transport direction
19=lengthwise draw control device
21=first longitudinal end (10)
22=articulated bearing (21)
23=second longitudinal end (10)
24=beam
25=first longitudinal end (24)
26=tilt bearing
27=second longitudinal end (24)
28=slant positioning device
29=slant positioning control device
30, 30'=measuring device
31=shrinkage system
32=shrinkage control device
33=compression means
34=tension regulator
35=roller

The invention claimed is:

1. Device for finishing a denim textile web (1) which, proceeding from unfinished goods, is supposed to be brought to predetermined reference values for finished width, skew and woof thread density, having a stretching device, which has both stretching means (4, 14) for drawing the textile web (1) in its length, as well as slant positioning means (28) for applying a skew, and having a shrinkage system (31) assigned in continuous operation, particularly subsequently, having compression means (33) for adjusting a woof thread density, comprising a single measuring device (30) for detecting the actual values of goods width, skew and woof thread density, which is connected, in a control circuit, in each instance, to control the stretching and slanted positioning means (4, 14; 28) of the stretching device, on the one hand, and the compression means (33) of the shrinkage system (31), on the other hand, to achieve the reference values, in each instance.

2. Device according to claim 1, wherein the measuring device (30) is assigned to the textile web (1) before the first finishing stage, particularly ahead of the stretching device (5).

3. Device according to claim 1, wherein the measuring device (30) follows at least the stretching device (5).

4. Device according to claim 1, wherein the measuring device (30) follows the stretching device (5) and the shrinkage system (31).

5. Device according to claim 1, wherein an optical detector having a digital camera is the measuring device (30).

6. Device according to claim 1, having a hot flue (5), in which the textile web (1) is guided up and down over a bottom and a top series (9) of guide rollers (11), in meander-shaped loops, wherein one of the roller series (9) is mounted, on one side, in a beam (24), and that the beam (24) rests in a tilt bearing (26) at its first longitudinal end (25), as well as on a lifting device (28) for regulated raising and lowering of the beam end (27) at its second longitudinal end (27), which is subsequent to the former in the web transport direction (3).

* * * * *